WASHING MACHINE FOR GLASSES AND THE LIKE

FIELD OF THE INVENTION

This invention is concerned with washing machines of the kind in which drinking glasses or other utensils are carried through wash and rinse zones on a conveyor.

REVIEW OF THE PRIOR ART

These machines are commonly found in bars and restaurants and usually comprise a cabinet which houses a conveyor, most usually an endless belt conveyor of which the belt is of open mesh structure, a drive mechanism for the conveyor and spray units which direct detergent, rinsing and sanitizing fluids through the belt into the interiors of the glasses carried, upside down, on the belt. Spray units may be provided to direct the fluids onto the glasses or other utensils from above or from the sides of the belt.

Operators of these machines will conventionally load the moving conveyor at one end and remove the cleansed utensils at the opposite end, the conveyor being switched on and off as required by the operator. As soon as the conveyor is switched on the sprays become operative and unless the operator is diligent the machine is often left running when no utensils are to be washed which is wasteful of both energy and water resources.

DEFINITION OF THE INVENTION

Applicant herein seeks to provide a washing machine which may be operated in a selected one of three different modes so that energy and water may be conserved.

According to the present invention there is provided a washing machine for glasses and other utensils, the machine having a loading zone, a washing zone and an unloading zone;

the machine having at the washing zone spray means for directing cleaning fluids onto the said glasses and other utensils;

the machine having a conveyor operable to convey glasses and other utensils placed thereon through the said loading, washing and unloading zones in the stated order, and including switch means operable by control means for controlling the operation of the conveyor for the conveyance of the glasses and other articles through the zones and for controlling the operation of the spray means at the working zone to work the glasses and other articles passing through that zone;

the said control means including a timed cycle mechanism causing the operation of the conveyor and of the spray means for a timed cycle period related to the distance of travel of the conveyor to convey glasses and other articles from the loading zone to the unloading zone and then stop the conveyor and the spray means;

the said control means including a control member that in one condition permits the operation of the said timed cycle mechanism, that in another condition disables the said timed cycle mechanism for operation of the conveyor and the spray means by a manual control connected to the control means and operable by a human operator, and that in a further condition disables the same timed cycle mechanism for operation of the conveyor and the spray means by a movable glass and other article detector disposed in the path of the conveyor at the unloading zone and connected to the control means for operative movement thereof to stop the conveyor and the spray means by corresponding engagement of a glass and other article with the said moveable detector.

Most desirably it will be seen that there is provided a machine which may be operated continuously, which may be operated on a timed cycle or which may be operated so as to be switched off automatically as a utensil reaches an unloading zone of the conveyor.

In each instance the control means may be preset at the factory, set upon installation or set at the will of an operator.

DESCRIPTION OF THE DRAWINGS

A machine which is a particular preferred embodiment of the present invention is illustrated schematically in the accompanying drawings, in which.

DESCRIPTION OF THE PREFERRED EMBODIMENT

Figure 1:
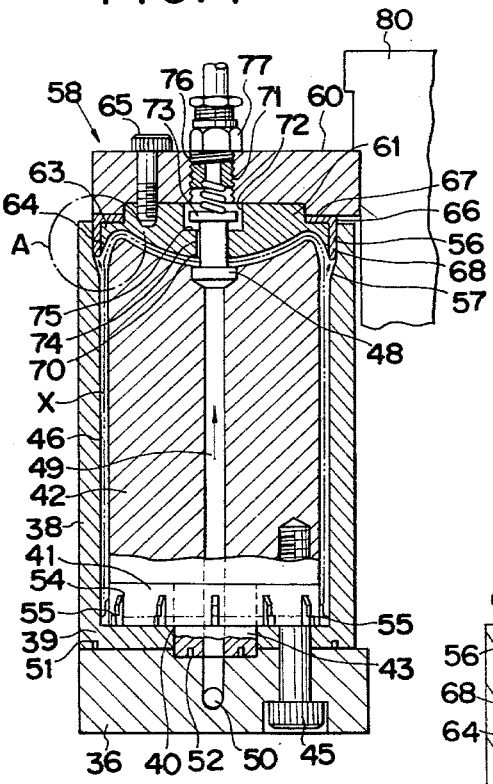
FIG. 1 is a perspective view of the machine according to the present invention, parts thereof being shown broken away as necessary for clarity of illustration.

The washing machine comprises a cabinet 10 in which is mounted an endless belt conveyor 12 comprising a belt 14 and drive and idler rolls 16 and 18 respectively. The belt 14 is of open construction so that spray means 19 of any conventional form may be disposed to direct different cleansing liquids as, for example, detergents, rinse water and sanitizers, into a cleansing wash and rinse zone 20 covered by a tunnel structure 22. The upper course 24 of the belt 14 provides the article-carrying surface and defines a loading zone 26 at its left hand end (as viewed in the drawings) and an unloading zone 28 at its right hand end, the wash and rinse zone being disposed between the loading and unloading zones. The drive end of drive roll 16 has a sprocket 30 about which a chain 32 is trained, the chain also being trained about a sprocket 34 of a drive motor and gearbox indicated generally by 36 and by which the conveyor is driven.

A control mechanism for the machine is indicated generally at 40 and is described in greater detail with reference to FIGS. 2 through 5. A slide bar 42 is mounted in the cabinet 10 for longitudinal back and front sliding movement parallel to the direction of travel of the belt 14. An on/off knob 44 is provided at the loading end of the conveyor, projecting upwardly from the bar 42 and secured thereto, while a similar knob 46 is provided at the unloading end, the knobs being slidable in elongated openings 48 and 50 respectively in the top wall of the cabinet 10.

A post 52 having a ramp 54 at its lower end projects downwardly from the slide bar, which ramp cooperates with the actuating arm 56 of a microswitch 58. The microswitch 58 is fixedly mounted upon a sub-frame assembly 60 and the ramp 54 projects through a window 62 in that assembly to cooperate with arm 56. An operating bar or lever 66 is pivoted to the post 52 about

PRIOR ART

APPARATUS FOR DEFATTING TREATMENT OF CONTAINERS

BACKGROUND OF THE INVENTION

This invention relates to an improvement in an apparatus for cleaning containers being open at one end, particularly seamless metal cans.

A lubricant is applied to seamless metal cans, for example, drawn and ironed cans (hereunder referred to as D & I cans) which are made from sheets of a metal such as aluminum or tinplate by drawing and ironing processings, in the drawing and ironing processings, respectively, for their manufacture, so it is necessary to carry out defatting treatment, that is, to remove said lubricant from the cans, prior to the subsequent steps (chemical treatment step and painting step).

As methods for defatting treatment of D & I cans, there have been known a method for defatting which comprises subjecting cans while moving on a net conveyor upside down to sprays of a defatting treatment liquid from over and below the conveyor and another one for defatting treatment which comprises placing D & I cans in an airtightly closable cell and introducing in the cell a liquid for defatting treatment which is a volatile cleaning liquid such as trichloroethylene.

This invention relates to an improvement in an apparatus for the latter type treatment.

An example of an apparatus for the latter type treatment is disclosed in U.S. Pat. No. 4,026,311 specification.

Figure 2:
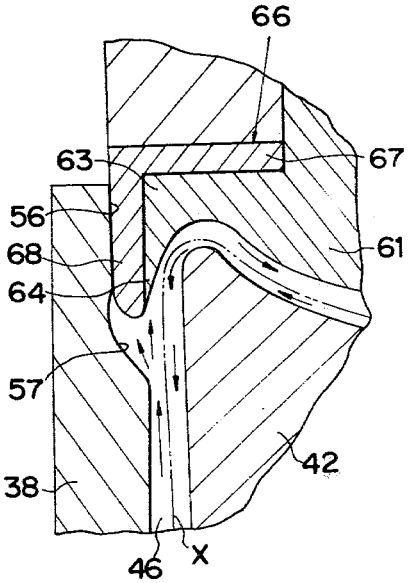
PRIOR ART FIG. 2
FIGS. 2, 3 and 4 are similar elevational views of the control mechanism of the machine of FIG. 1, showing the mechanism in different positions to give respective control functions.

In the accompanying drawings, FIG. 1 is a sectional view of the apparatus forming the cell for defatting treatment of seamless cans shown in said U.S. patent specification, and FIG. 2 is an enlarged view of the A portion of FIG. 1.

The apparatus shown in FIG. 1, that is, a pot assembly, comprises a support plate 36 secured to a top plate (not shown) by a securing means; an upright cylindrical shell 38 mounted on this support plate 35, the top of the shell being open and the bottom having an end wall 39 formed with a central aperture 40; a centering ring 41 mounted on said end wall 39; and a cylindrical core 42 mounted on said ring 41, the bottom of the core having a spigot 43 which extends as a close fit through said centering ring 41 and said aperture 40, and the bottom of this spigot 43 being seated in a recess in the support plate 36. Screws 45 extend upwards through the support plate 36, the end wall 39 and the ring 41, and are screwed into the core 42 thereby securely clamping the components together. The core 42 co-operates with the shell 38 to form a cavity 46 for the reception of a container X (shown by a two-dotted chain line) to be treated for defatting. A recess is formed in the center area of the top of the core 42, and a duct 49 extends from the recess downwards through the core 42 and the spigot 43 and connects with a duct 50 in the support plate 36. These ducts 49 and 50 form a first passage for treating fluid (inlet passage). Sealing rings 51 and 52 are mounted in grooves in the bottom surfaces of the shell 38 and the spigot 43, respectively. The centering ring 41 has an outer surface which is aligned with the outer surface of the core 42, and the centering ring 41 is provided with many axially extending fins 54 spaced around the ring, the fins 54 being adapted to engage inside the mouth of a container fed open-end downwards onto the core 42 so as to fix co-axially the container to the core 42, and each fin 54 is formed with a ledge 55 for the support of a container. The inside diameter of the upper end part 56 of the shell 38 is larger than that of the other part of the shell, and the inner surface 57 of the shell immediately below said part 56 is tapered downwardly.

The pot assembly described in this U.S. patent includes a lid 58 consisting of a cover plate 60; a crown 61 located in a recess in the underside of the plate 60 and having an annular peripheral flange 63 formed with a downwardly projecting lip 64, the crown being secured to the cover plate 60 by screws 65; and an annular sealing member 66 having a radical wall 67 clamped between the flange 63 and the cover plate 60, and a cylindrical wall 68 extending downwards below the lip 64. The crown 61 is formed with a central aperture 70 aligned with an aperture 71 in the cover plate 60, the upper portion of the aperture 70 being enlarged to form a valve chamber 72 housing a valve member 73 having a stem 74 slidably mounted in the lower portion of the aperture 70.

The valve member 73 is adapted to block the flow of fluid through the apertures 70 and 71 when in a closed position in which it is engaged against the bottom wall 75 of the valve chamber by a spring 76 compressed between the valve member 73 and a tubular pipe connector 77 screwed into the aperture 71. The fluid can flow through the apertures 70 and 71 when the valve member 73 is in an open position spaced from the wall 75 of the valve chamber. These apertures 70 and 71 form a second passage for treating fluid (outlet passage). The cover plate 60 is secured to a sleeve 80 which is movable up and down and is rotatable.

In order to subject seamless cans with a lubricant adhering thereto to defatting treatment using the pot assembly, first the sleeve 80 is operated to lift the cover plate 60 to a position at which the lower end portion of the crown 61 rigidly secured to the cover plate becomes higher than the upper end of the cylindrical shell 38, and then the cover plate 60 is rotated around the sleeve 80 so that the can X may be inserted in the cavity 46 defined by the shell 38, the core 42 and the centering ring 41. After the can X is inserted in the cavity 46, the cover plate 60 is rotated around the sleeve 80 and then moved down to airtightly close the cavity 46 with the crown 61.

Here, the gap between the shell 38 and the crown 61 is kept in a sealed state through the annular sealing member 66 composed of an elastic material. Next, a defatting liquid such as trichloroethylene is injected via the first passage for treating fluid. The injected defatting liquid moves up through the duct 50 and then the duct 49, makes headway between the inner surface of the bottom of the can X and the top surface of the core 42, flows down between the inner surface of the body of the can X and the outer surfaces of the core 42 and the centering ring 41, passes through between the respective fins 54 of the centering ring 41, moves up between the outer surface of the body of the can X and the inner surface of the shell 38, makes headway between the outer surface of the bottom of the can X and the inner surface of the crown 61 and then is discharged through the ducts 70 and 71 composing the second passage for treating fluid. During this time, said inner and outer surfaces of the can X is cleaned with the trichloroethylene. Then, detergent-containing water is injected through the first passage for treating fluid to clean said both surfaces of the can X with the detergent-containing water. Last, air at a high temperature is injected through the first passage for treating fluid to dry the cavity (in which the can X is placed).

The foregoing method for defatting treatment requires the use of water and the use of a volatile cleaning liquid, and thus the method has drawbacks in that the long time necessary for the drying keeps the defatting treatment time from being shortened satisfactorily, and the treatment cost is high as it is hard to reuse the fluid after the treatment.

In order to apply a defatting treatment method, which is carried out in the field of metal processing other than for can manufacture, that is, a two-step defatting treatment method where pre-wash with treating fluid in a liquid state is first carried out, and then wash proper using the same type treating fluid in a vapor state, is effected, to the defatting treatment of D & I cans using a pot assembly of the above U.S. patent without being accompanied by the above-mentioned drawbacks, the inventors of the present invention subjected D & I cans to defatting treatment in the following order of steps.

That is, a can is inserted in the cavity in a pot assembly as shown in FIG. 1, (1) first, both the inner surface and the outer surface of the can are preliminarily defatted with methylene chloride in a liquid state while it is injected through the first passage for treating fluid and discharged via the second passage for treating fluid;

(2) then, gaseous methylene chloride is injected under pressure through the first passage for treating fluid to defat both the inner surface and the outer surface of the can with the gaseous methylene chloride while discharging the liquid methylene chloride adhering to the surface of the can in and the wall of the cavity;

(3) after that, methylene chloride in a liquid state purified by distillation is injected through the first passage for treating fluid to subject both the inner surface and the outer surface of the can to defatting proper until it is discharged via the second passage for treating fluid;

(4) the same treatment as in the above (2) is repeated;

(5) the methylene chloride adhering to the surface of the can and the wall of the cavity is removed by vacuum suction through each of the first and second passages for treating fluid, and at the same time the cavity is dried;

(6) thereafter, the methylene chloride in the cavity is completely removed by pressurized air injected through the first passage for treating fluid; and (7) then, the crown is lifted and rotated to open the cavity and to take out the can.

The complete removal of the methylene chloride from the cavity is a necessary step for the prevention of the loss of the volatile cleaning liquid and for the prevention of the release of the gaseous fluid into the air which it might damage human bodies.

Here, the defatting treatment consisting of the above steps is carried out by injecting treating fluid into the cavity of the pot assembly and charging said fluid out of said cavity in such a manner that the above respective steps are effected successively while said pot assembly is transferred along a predetermined passageway.

The degree of defatting of cans subjected to defatting treatment consisting of the above steps was examined to find that the lubricant still adheres here and there on the surfaces of the cans which must have surely been subjected to the defatting treatment. If the lubricant adheres to the surfaces of cans, one fails in complete chemical treatment of the surfaces of such cans in the subsequent step, and they will be judged to be rejects for their poor resistance to rust and poor adhesion of paint.

In order to find the reason why the lubricant adheres to the cans, we further made experiments for examination to reveal that the adhesion is attributable to the apparatus.

That is, as is clearly understood from FIG. 2, the upper portion of the shell 38 has a recessed tapered portion 57, and the cylindrical wall 68 of the annular sealing member 66 extends downward to the upper portion of this tapered portion 57 to form a pocket. As arrows show, aqueous methylene chloride moves up between the outer surface of the can X and the inner side wall of the shell 38 cleaning the surfaces of the cans, and a part of the fluid enters the above pocket. This part of the fluid which contains a part of the lubricant washed off from the surfaces of the cans therewith is left in said pocket (said part of the fluid and that of the lubricant remain adhering to the surface of the tapered portion of the shell 38 and the end surface of the cylindrical wall 68 of the annular sealing member 66), and the remaining fluid is discharged.

This part of the lubricant (more particularly, the lubricant in admixture with the methylene chloride) still remains adhering to the pocket portion without being completely wash off even after the passing of gaseous methylene chloride, and adheres to the outer surfaces of the cans by suction when the vacuum treatment in the above step (5) is carried out.

SUMMARY OF THE INVENTION

This invention is directed to overcome the above-mentioned drawbacks of the prior art apparatus and is to provide an apparatus which prevents a lubricant from adhering to the surfaces of cans subjected to defatting treatment which is carried out using a volatile cleaning liquid for defatting treatment.

According to this invention, there is provided a pot assembly of a structure which does not provide a pocket or other places in which a lubricant may be left between the shell and the crown referred to above and which further does not damage the sealing performance.

More particularly, the following apparatus is provided according to this invention.

An apparatus for subjecting containers being open at one end to defatting treatment with a volatile cleaning liquid for defatting treatment which is a pot assembly composed of a body and a crown, the body being composed of a centering ring, a core and a shell;

the centering ring being provided with a plurality of fins at the lower end thereof, said fins having projections for receiving and supporting the open end of the container, the core having outer and top surfaces of figures similar to the body and bottom surfaces of said container and being fitted with said centering ring at the lower end thereof, the shell being outside of said centering ring and said core, the inner surface of the shell being of a figure similar to that of the body surface of said container and a narrow gap being formed between the inner surface of the container and the outer surfaces of the centering ring and core;

a cavity for the reception of said container being defined by said centering ring, core, shell and crown;

the crown being fitted with the open end of said shell to seal said cavity;

the cavity being divided into two chambers by receiving said container into said cavity at a predetermined place;

the cavity being of a size enough to admit said volatile cleaning liquid for defatting treatment to fill up these two chambers and flow along the inner and outer surfaces of said container; and the pot assembly being provided with inlet and outlet passages for said cleaning liquid for defatting treatment;

the characteristic aspect being in that, when said cavity is sealed, at least said shell and said crown form a sealing portion, and the inner surfaces of said shell and crown adjacent to the sealing portion are smooth and form substantially one plane.

The above-mentioned apparatus encompasses the following embodiments:

(1) An apparatus according to the above apparatus where said shell and said crown are directly in contact with each other to form said sealing portion.

(2) An apparatus according to the above apparatus where a sealing member is set between said shell and said crown to form said sealing portion together with said shell and said crown.

(3) An apparatus according to the above (2) where said sealing member is exposed to said cavity;

(4) An apparatus according to the above (2) where said sealing member is not exposed to said cavity; and (5) An apparatus according to the above (3) where the inner surface of said sealing member (the surface being exposed to the cavity) forms substantially one plane with the inner surfaces of said shell and said crown.

BRIEF DESCRIPTION OF THE DRAWINGS

Figure 3:
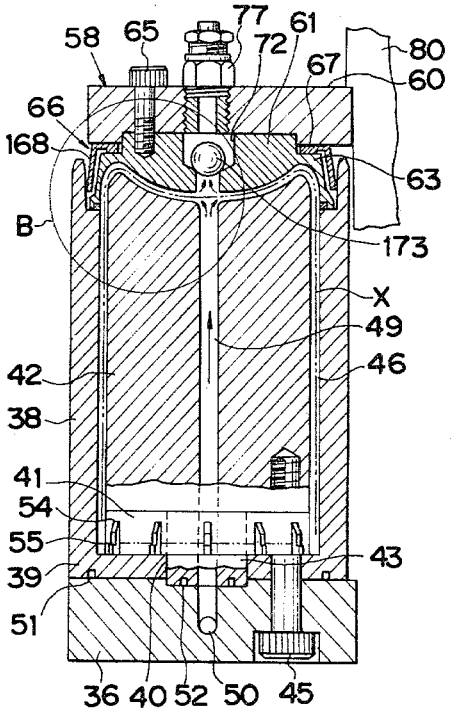
Figure 4A:
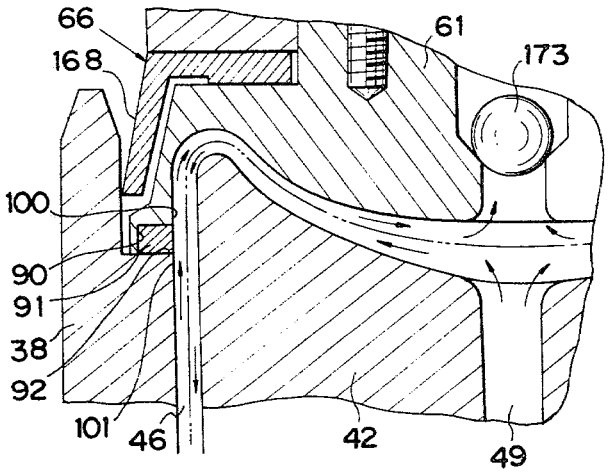
Figure 4B:
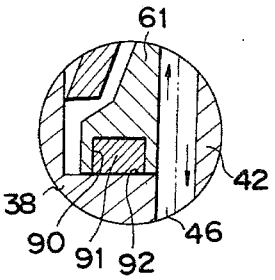
Figure 5:
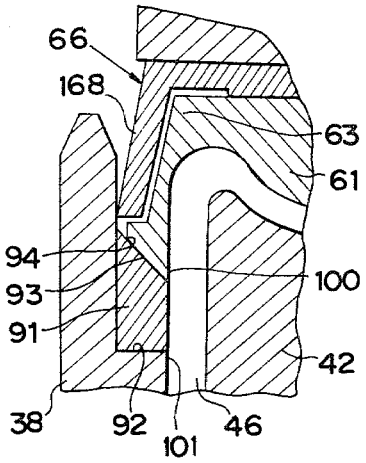
FIG. 5 is an exploded view of a detail of the control mechanism of FIGS. 2 through 4.
Figure 6:
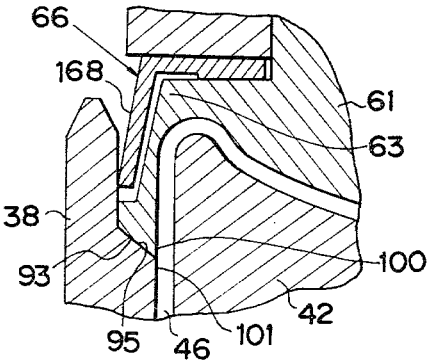

FIG. 1 is a longitudinal section of the prior art pot assembly for defatting treatment;

FIG. 2 is an enlarged view of the A portion of FIG. 1;

FIG. 3 is a longitudinal section of an example of the pot assembly for defatting treatment according to this invention;

FIG. 4*a* is an enlarged view of the B portion of FIG. 3;

FIG. 4*b* is a longitudinal section showing an improvement in a part of the pot assembly shown in FIG. 4*a*;

FIG. 5 is an enlarged sectional view of the portion of another example of the pot assembly according to this invention which corresponds to that shown in FIG. 4*a*; and FIG. 6 is an enlarged sectional view of the portion of a further example of the pot assembly according to this invention which corresponds to that shown in FIG. 4*a*.

DETAILED DESCRIPTION OF PREFERRED EMBODIMENTS

Hereunder, examples of this invention will be explained with reference to drawings.

Most of the respective portions of the apparatus shown in FIG. 3 and FIG. 4*a* correspond to those of the apparatus shown in FIGS. 1 and 2, and the same numbers stand for the same structural portions. Main differences are in that, in the apparatus shown in FIGS. 3 and 4*a*, the crown 61 is provided with an annular recess 90 in the inner surface of the lower end portion of the annular peripheral flange 63, and the elastic sealing member 91 the underside of which is horizontal and one side surface of which faces the cavity 46 directly is received in and rigidly secured to said recess 90; the inner surface of the upper end part of the shell 38 is cut off to form a horizontal plane 92 extending towards the core 42, where a sealing portion is formed between the shell 38 and the crown 61 including said member 91; and the inner surfaces 101 and 100 of said shell and said crown adjacent to the sealing portion and the inner surface (exposed to the cavity) of said sealing member 91 form a smooth surface without a recess and are substantially in one plane.

D & I cans with a lubricant adhering thereto were subjected to defatting treatment in the same manner as in the above steps ((1)-(7)) using the above example of the pot assembly of this invention. As the result, no cans were found on which the remaining lubricant adhered.

Defatting treatment with only a volatile cleaning liquid using an apparatus which is constructed by placing many pot assemblies of this invention on the periphery of a rotatable member has advantages in that, as compared with defatting treatment which comprises spraying an aqueous fluid for defatting treatment upon cans carried on a net conveyor upside down, treatment at higher speeds is available, and the apparatus may be made more compact (that is, less space is required for the installation), and further it has an additional advantage in that it may be carried out at higher speeds even as compared with the treatment method disclosed in U.S. Pat. No. 4,026,311.

Actually complete sealing surface is formed between the horizontal plane 92 and the sealing member 91 having the horizontal underside, and thus such structure. The annular sealing member 66 is to prevent the gaseous fluid from leaking outside the pots by some rare accident. Then it is not essential for this invention to have the annular sealing member 66.

As to another example of this invention shown in FIG. 5, it differs from the pot assembly shown in FIGS. 3 and 4*a* in that the lower end portion of the annular peripheral flange 63 is shaped to have an inclined surface 93 which leans toward the cavity 46. The sealing member 91 having an inclined upper surface 94 which leans toward the cavity is secured to the horizontal plane 92 of the shell 38. Both the inclined surfaces 93 and 94 form the sealing surface. In the same way, the inner surface of the sealing member 91 and the inner surfaces 101 and 100 of the shell 38 and the crown 61 each adjacent to the sealing member 91 form a smooth surface in one plane without a recess. Accordingly, the lubricant washed off from the surfaces of the cans with a volatile cleaning liquid such as methylene chloride never remains on and adheres to the shell, crown and sealing member, and is easily discharged together with a gaseous fluid. Thus, different from the case where the pot assembly shown in FIGS. 1 and 2 is used, there is no possibility that the lubricant remaining in the gap or the recess in the inner surface of the assembly will be sucked up in the step of vacuum suction and adhere to the surfaces of the cans.

The points in which a further example of the apparatus of this invention shown in FIG. 6 differs from the pot assembly shown in FIG. 5 are that the upper portion of the shell 38 has an inclined surface 95 leaning toward the cavity 46 instead of the horizontal plane 92, and the sealing member 91 is omitted. In this example, the inclined surface 93 of the lower end portion of the annular peripheral flange 63 and the inclined surface 95 of the shell 38 are directly in contact with each other to form a sealing surface.

Even in this example, the inner surfaces 101 and 100 adjacent to the sealing portion each are smooth and are substantially in one plane. Therefore, it is unlikely that the lubricant washed off from the surfaces of the cans with a volatile cleaning liquid such as methylene chloride will adhere to and remain on the inner surface of the pot assembly, and the lubricant is discharged together with the liquid. Thus, the remaining lubricant is neither sucked up in the step of vacuum suction nor does it adhere to the surfaces of the cans.

In addition, if a part of the pot assembly shown in FIG. 4*a* is improved as shown in FIG. 4*b* to insert the sealing member 91 in the crown 61 thereby providing such structure that said member 91 is not exposed to the cavity 46, the life of the sealing member is prolonged.

As mentioned above, according to this invention, when the cavity is sealed, the inner surfaces of at least said shell and crown adjacent to the sealing portion are substantially in one plane. Accordingly, this invention has effects that the lubricant once washed off from the surfaces of the cans with a volatile cleaning liquid never adheres to and remain on any portion of said two parts, and no lubricant adheres to the surfaces of the cans in the step of drying their surfaces and while discharging the gas used in the drying from the cavity.

What we claim is:

1. An apparatus for subjecting containers being open at one end to defatting treatment with a volatile cleaning liquid for defatting treatment which is a pot assembly composed of a body and a crown, the body being composed of a centering ring, a core and a shell;

the centering ring being provided with a plurality of fins at the lower end thereof, said fins having projections for receiving and supporting the open end of the container, the core having outer and top surfaces of figures similar to the body and bottom surfaces of said container and being fitted with said centering ring at the lower end thereof, the shell being outside of said centering ring and said core, the inner surface of the shell being of a figure similar to that of the body surface of said container and a narrow gap being formed between the inner surface of the container and the outer surfaces of the centering ring and core;

a cavity for the reception of said container being defined by said centering ring, core, shell and crown;

the crown being fitted with the open end of said shell to seal said cavity;

the cavity being divided into two chambers by receiving said container into said cavity at a predetermined place;

the cavity being of a size enough to admit said volatile cleaning liquid for defatting treatment to fill up these two chambers and flow along the inner and outer surfaces of said container; and the pot assembly being provided with inlet and outlet passages for said cleaning liquid for defatting treatment;

the characteristic aspect being in that, when said cavity is sealed, at least said shell and said crown form a sealing portion, and the inner surfaces of said shell and crown adjacent to the sealing portion are smooth and form substantially one plane.

2. An apparatus according to claim 1 wherein said shell and said crown are directly in contact with each other to form said sealing portion.

3. An apparatus according to claim 1 where a sealing member is set between said shell and said crown to form said sealing portion together with said shell and said crown.

4. An apparatus according to claim 3 where said sealing member is exposed to said cavity.

5. An apparatus according to claim 4 where the inner surface of said sealing member (the surface being exposed to the cavity) forms substantially one plane with the inner surfaces of said shell and said crown.

6. An apparatus according to claim 3 where said sealing member is not exposed to said cavity.

* * * * *